United States Patent [19]

Kamata et al.

[11] 4,148,108

[45] Apr. 10, 1979

[54] APPARATUS FOR POLISHING CATHODE PLATES FOR METAL ELECTROLYTIC REFINERY

[75] Inventors: Sachio Kamata; Kunio Sekine, both of Akita, Japan

[73] Assignees: Dowa Mining Co., Ltd.; Akita Zinc Co. Ltd., both of Tokyo, Japan

[21] Appl. No.: 721,367

[22] Filed: Sep. 8, 1976

[30] Foreign Application Priority Data

Sep. 13, 1975 [JP] Japan ..... 50-110504

[51] Int. Cl.[2] ..... A46B 13/04

[52] U.S. Cl. ..... 15/77; 51/80 R

[58] Field of Search ..... 15/77, 102; 51/23, 80 R, 51/83 R

[56] References Cited

U.S. PATENT DOCUMENTS 3,501,795 3/1970 Jasberg ..... 15/77

*Primary Examiner*—Edward L. Roberts

*Attorney, Agent, or Firm*—Toren, McGeady and Stanger

[57] ABSTRACT

Apparatus for polishing metal electrolytic refining cathode plates, in which cathode plates are transported individually by means of a series of transferring and hanging devices, with the cathode plates thus transferred being polished in a polishing mechanism while moved vertically and while their dielectric frame supporters are protected so as not to be subjected to the polishing operation effected by the polishing mechanism.

4 Claims, 21 Drawing Figures

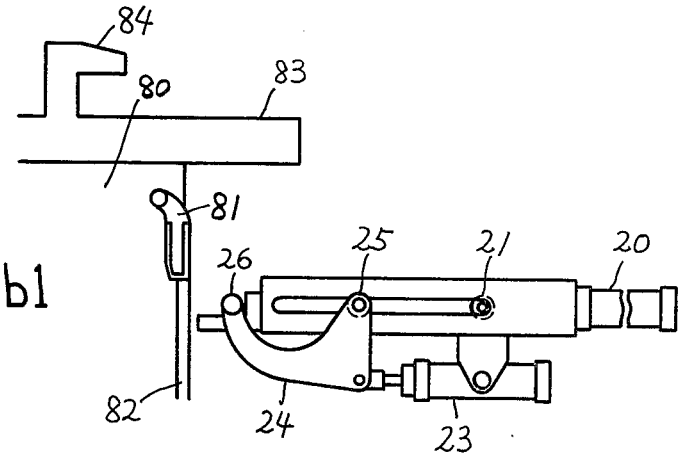
FIG. 6-b1
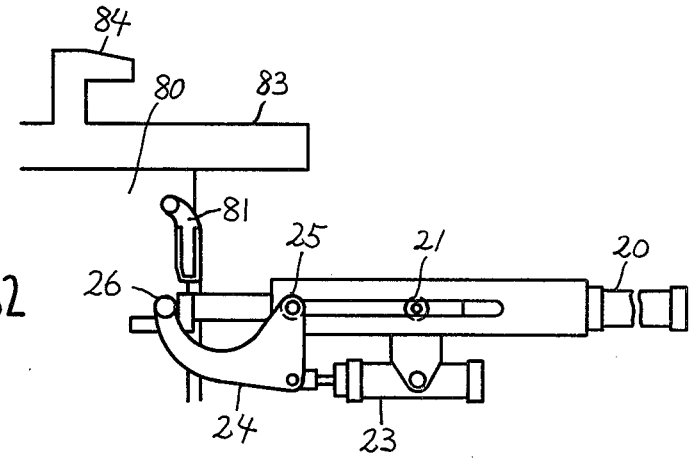
FIG. 6-b2
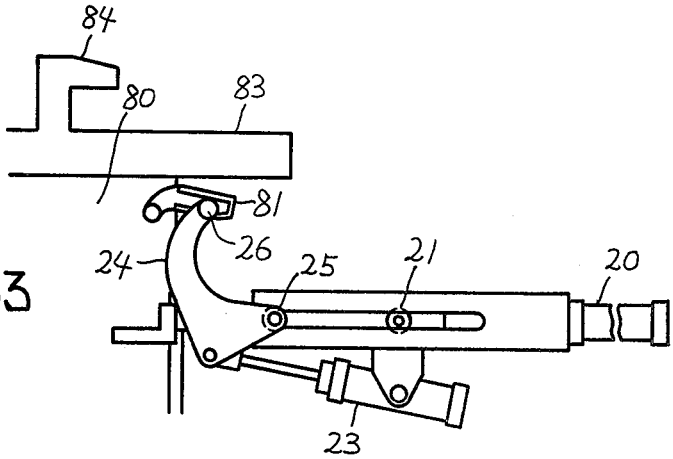
FIG. 6-b3

FIG. 13
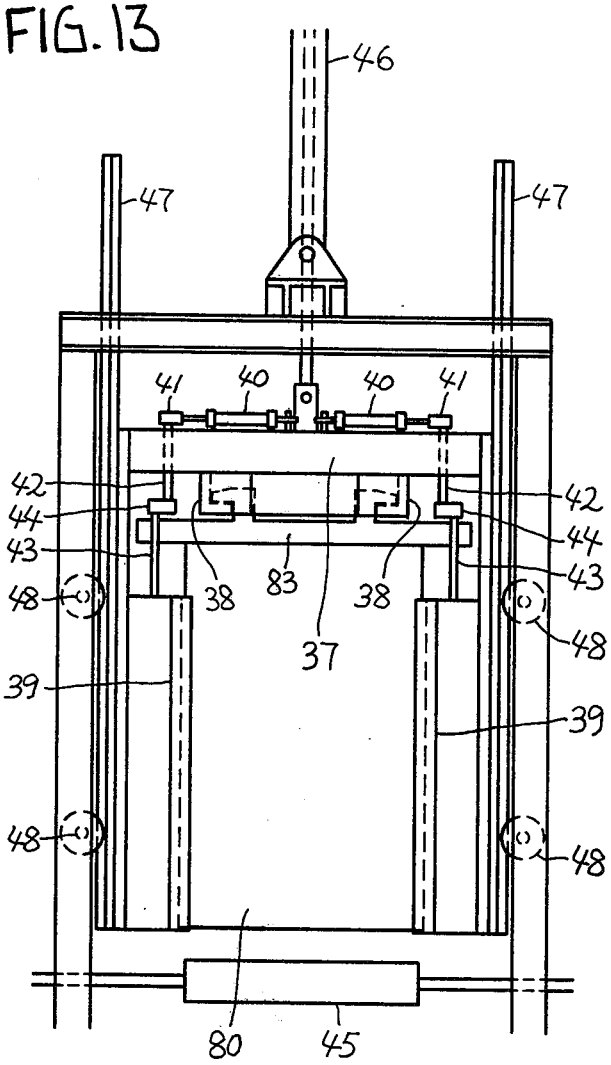
FIG. 14
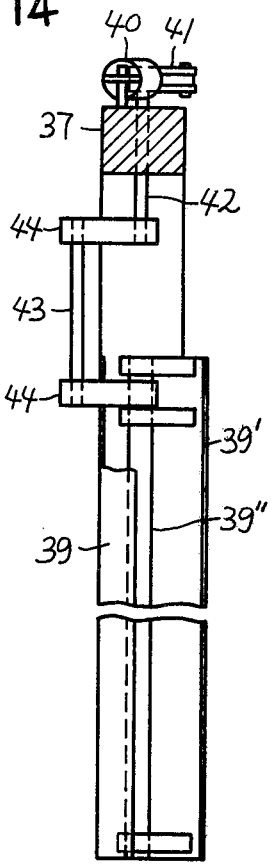
FIG. 16
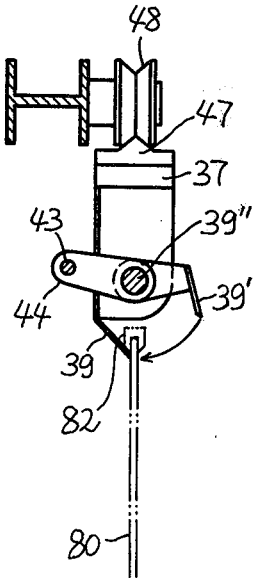
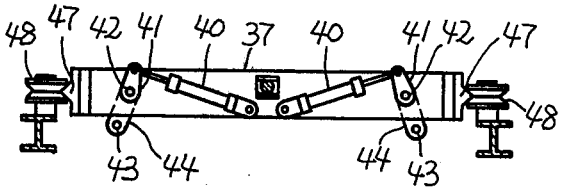
FIG. 15

APPARATUS FOR POLISHING CATHODE PLATES FOR METAL ELECTROLYTIC REFINERY

BACKGROUND OF THE INVENTION

This invention relates to an apparatus for polishing a metal electrolytic refining cathode plate.

Since cathode plates used in a metal electrolytic refinery are adversely affected on their surfaces by acids, metallic ions, halogens and the like during their operations, their surfaces need to be polished periodically.

It is most common that cathode plates of the kind mentioned above are polished after having been immersed for a predetermined time in an electrolytic bath, removed of metals deposited on the surfaces, and washed by water. In performing the above operations, a number of cathode plates are aligned with minimum spacing therebetween and transported simultaneously from an operational step to other steps, in order to meet the space provided in an electrolytic bath and a water bath and also in order to make the transportation of cathode plates easier. It should be noted also that cathode plates of this kind are fitted along their circumferential edges with stationary supporters which are made of dielectric materials and which prevent electrodepositions on front and back surfaces of the plates from joining together along the edges so as to make the stripping of the electrodepositions from the cathode plates easier. Conventionally, these stationary supporters are manually removed from the plates when the plates are polished, and they are refitted manually onto the plates after they have been polished. Sometimes, parts of these supporters are pivoted at a lateral upper side of the plates so as to be movable for achieving the automatic stripping of electrodepositions adjacently to the pivotal points of the plates.

Irrespective of whether such supporters are stationary or movable, the existence of the supporters interferes with polishing of the cathode plates.

Hence, it is an object of this invention to provide a polishing apparatus or system for metal electrolytic refining cathode plates, in which the plates are automatically polished while their stationary supporters are fitted to the plates, and in which the abrasion of the supporters during the polishing of the plates is avoided. In this invention, when the supporters are pivotally movable, they are shifted upwardly during the polishing of the cathode plates, so as to prevent the abrasion of the supporters.

SUMMARY OF THE INVENTION

More specifically, the invention is directed to a polishing apparatus or system of the kind mentioned above comprising conveyor means which stocks and automatically conveys a desired number of cathode plates to the succeeding means, supplying means which supplies the cathode plates individually to the succeeding loading hanger means, said loading hanger means receiving the cathode plates from the aforementioned supplying means to carry the cathode plates into an alignment suitable for polishing, pusher means for forwarding or withdrawing the thus aligned cathode plates into and from an elevator frame, protecting means of stationary supporters, polishing means with wire brushes, cathode plate receiving means and aligning conveyor means. The invention is characterized in that said means are operated by pneumatic or hydraulic fluid pressure means which are electrically controlled so as to automatically transfer the cathode plates to each means and to polish them.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE DRAWINGS

In the drawings:

FIG. 3-*b* is a sectional view showing details of the laterally transferring hanger means;

FIGS. 6-*b*1, 6-*b*2 and 6-*b*3 show, respectively, the lifting means at different points of operation;

FIGS. 13, 14 and 15 are, respectively, front, side and top views showing details of the elevator frame means and the protector means; and FIG. 16 is a partially sectioned top view illustrating the protector means.

DESCRIPTION OF THE PREFERRED EMBODIMENTS

Figure 1:
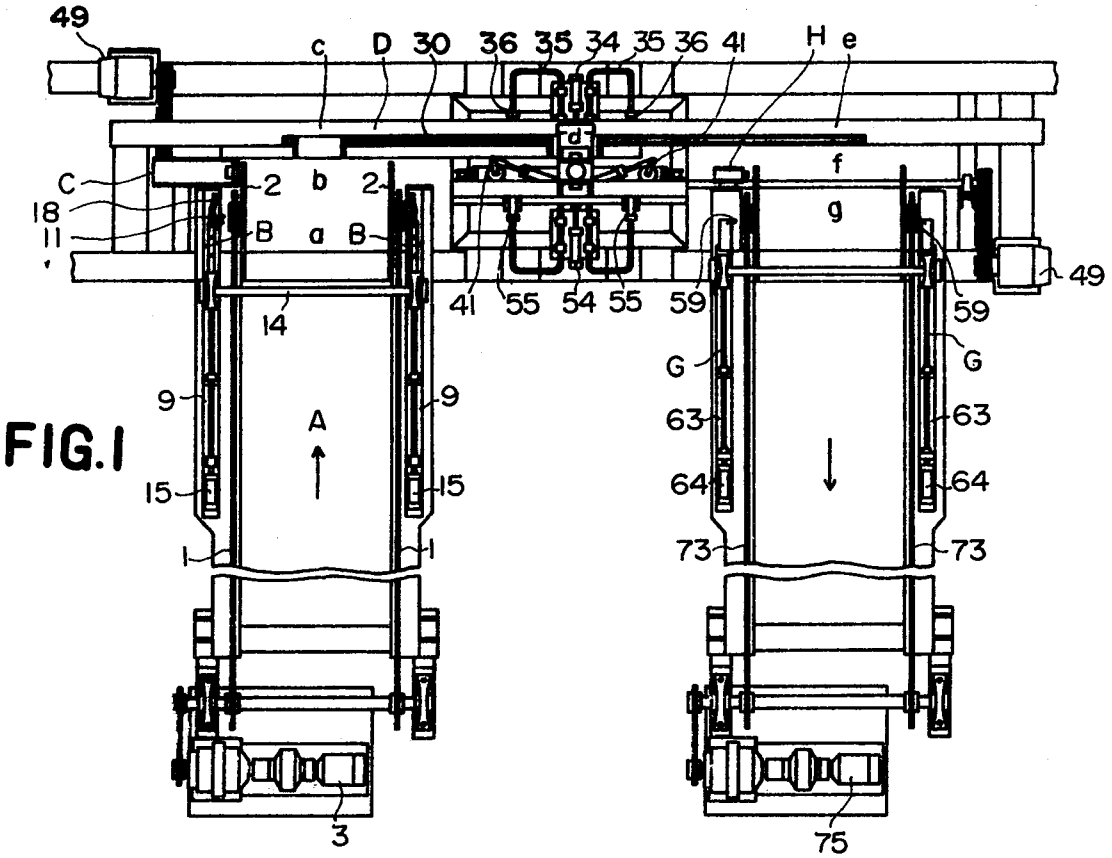
FIG. 1 is a plan view of the polishing apparatus as a whole, made in accordance with the present invention.

The invention will be described in detail by reference to the main elements thereof as depicted in the drawings.

Stock Conveyor Means A

A number of cathode plates which are required to be polished are removed from a water bath (not shown) by a crane, while they abut each other at their surfaces and hung onto the stock conveyor means. The stock conveyor means consists of left and right chain conveyors 1 which are intermittently operated by an electric motor 3. These two chain conveyors move at the same speed towards an arrow shown in the drawing, and stop automatically when a cathode plate reaches the position a. When one of cathode plates 80 is removed by a supplying means B, the conveyors move again. The stock conveyor means A are operated intermittently by the electric motor 3 in synchronism with the movement of a positioning pawl 11 which engages the plates. A cycle of operation entails movement through positions a, b and c and return to original position a. Thus, cathode plates 80 are taken from the stock conveyor means A one by one.

Cathode Plate Supplying Means B

Figure 4:
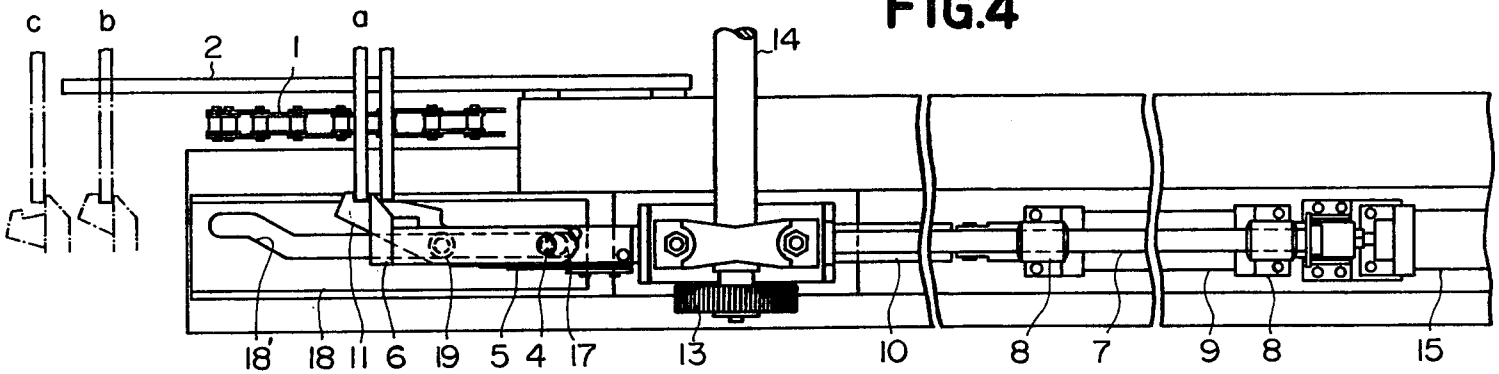
FIG. 4 is a plan view of supplying means of cathode plates.
Figure 5:
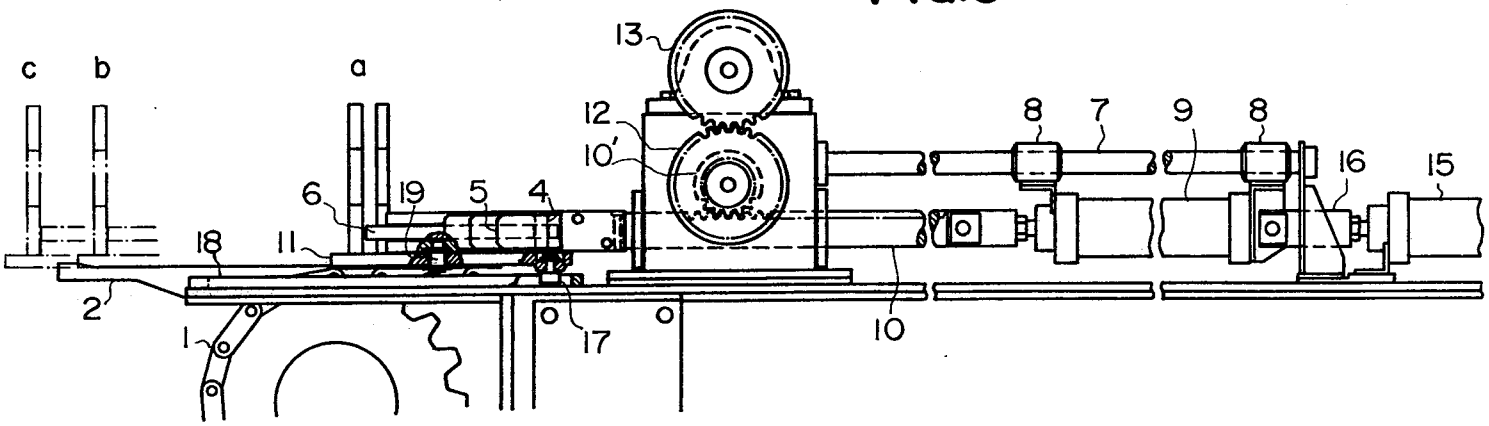
FIG. 5 is a side view of the same.
Figure 4B:
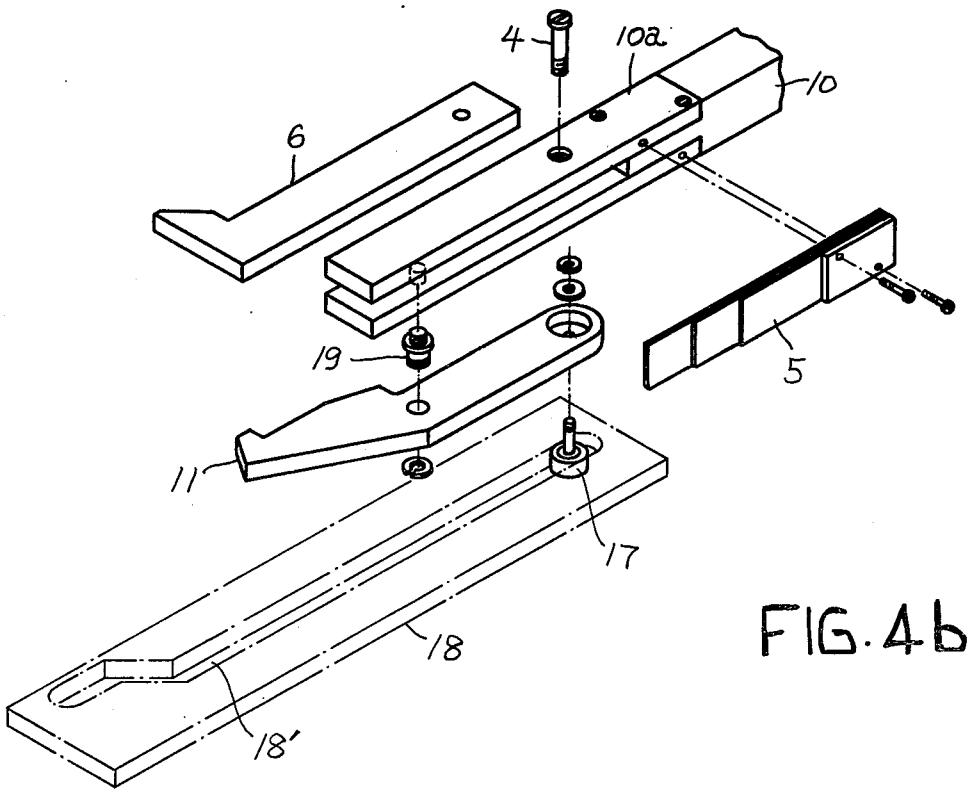
FIG. 4*b* is an exploded view showing part of the supplying means in more detail.

As best shown in FIG. 1, FIG. 4 and FIG. 5, before the cathode plate 80 reaches the position a, a cathode beam 83 of the cathode plate 80 abuts against a pawl 6 which is provided on a rack rod 10 and biased by a resilient plate 5 to be movable leftwardly or rightwardly, as seen in FIG. 4, about a pin 4. The beam 83 pushes said pawl aside and moves past it. When the plate after passing the pawl 6 reaches the position a, the pawl 6 returns to its normal position abutting against the rear side of the cathode beam 83. The front side of the cathode beam 83 is engaged by a front pawl 11 which prevents the cathode plate 80 from moving away. The front pawl 11 is pivotally mounted on the rack rod 10 by a pin 19. Then, a cylinder 9 which is suspended on a guide rod 7 and guide metals 8 operates and the rack rod 10 moves forwardly. Hence, the cathode plate thus engaged between pawls 6 and 11 travels until a position b which is located just in front of a loading hanger D, guided upon rails 2 running in parallel with the stock chain conveyors. Gears 10', 12, 13 which mesh with the rack rod 10 and a counter-shaft 14 operate to synchronize a rack rod on the opposite side with movement of the rack rod 10.

A second cylinder 15 transfers to a position c by means of protrusion of a rod 16 the cathode plate which has been engaged by the front pawl 11 and the pawl 6. At position c, a roller 17 which is provided to the front pawl 11 and moves in a guide slot 18' of a guide plate 18 makes the front pawl 11 rotate outwardly about a pin 19 as indicated by dotted lines in the c position in FIG. 4 whereby the pawl is released from the cathode beam 83. When this operation is completed, the pawl 6 and the front pawl 11 return to their original positions by succeeding retraction of the rod 16 and the rack rod 10.

The arrangement of the positioning pawl 11 and its associated parts are illustrated in more detail in FIG. 4-*b*.

A bifurcated support 10*a* is fixed to the forward end of the rack rod 10. The pawl 6 is pivoted by the pin 4 between the two horizontally extending parallel arms of the bifurcated support 10*a*, and its forward end is biased inwardly by the resilient plate 5 which is fitted to the support 10*a* at its lateral outer side. When a cathode plate 80 moving toward the a position abuts the forward end of the pawl 6, it is swung outwardly against the resilient plate 5, allowing the cathode plate to pass therethrough and returning to its normal position. The positioning pawl 11 is pivotally fitted to the bottom side of the support 10*a* by the aforementioned pin 4 and another pin 19. The free end of the pin 4 is fitted with a rotatable roller 17 which engages with the guide slot 18' of the guide plate 18. While the roller is positioned at the linear portion of slot 18', the positioning pawl 11 remains in its closed position. Hence, at the positions a and b, the cathode plate 80 which has passed over the pawl 6 is nipped by the pawl 6 at its rear edge and by the positioning pawl 11 at its front edge and is maintained in engagement therebetween. When the support 10*a* moves forward with the operation of rod 10, the roller 17 comes to engage the inwardly curved portion of the slot 18', whereby the positioning pawl 11 is swung outwardly to its open position. This corresponds to the position c.

The positioning pawl 11 is then moved from the position c to the original position a, whereupon the cycle described above is repeated.

Means C for Lifting Movable Supporters

Figure 6:
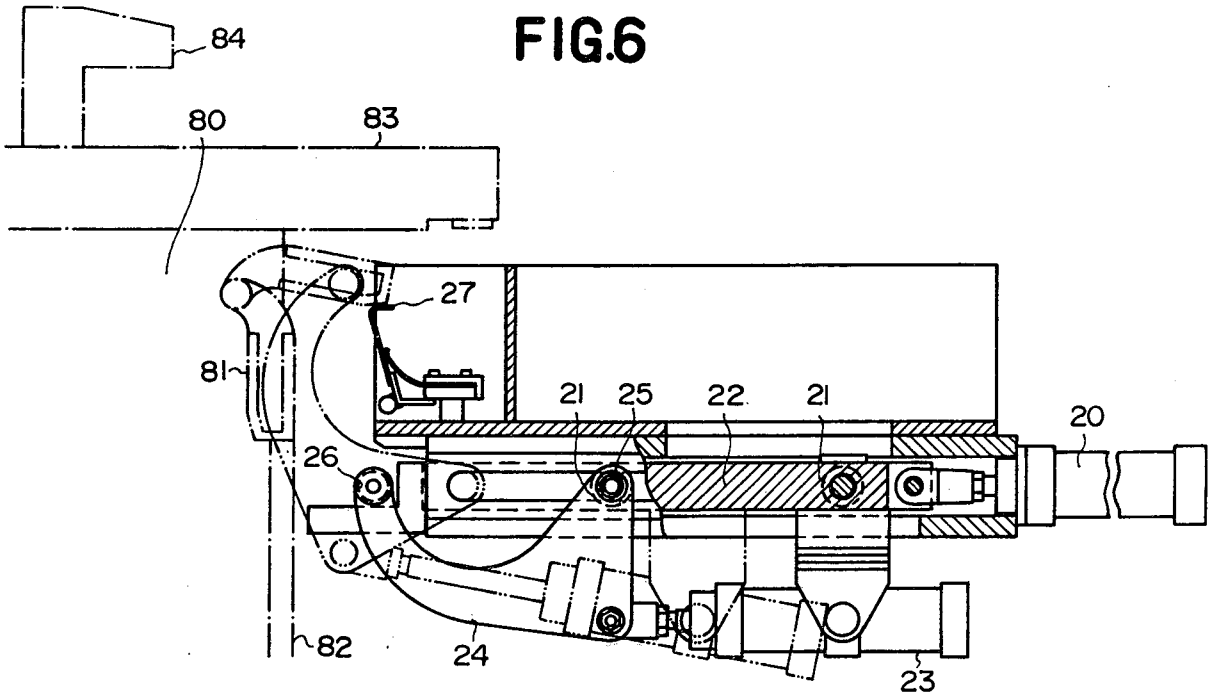
FIG. 6 is a side view of means for lifting movable supporters.
Figure 7:
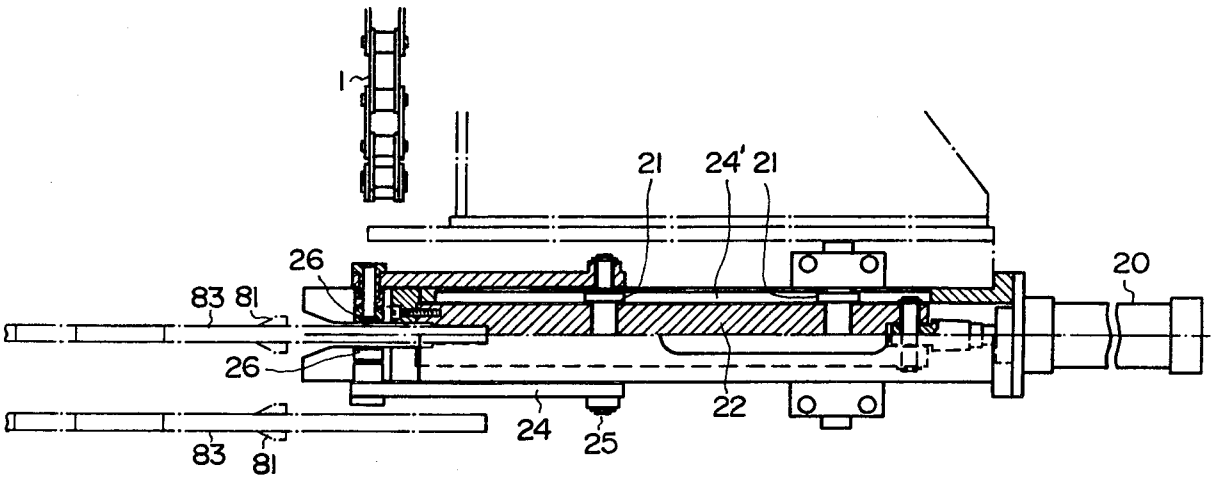
FIG. 7 is a plan view of the same.

When the cathode plates are provided at their upper edges with movable supporters 81 (FIGS. 6 and 7), the means C operates, as illustrated in FIGS. 6 and 7, at the position b of FIGS. 1, 4 and 5. Movable supporters 81 or movable cathode holders of this kind are of the type described in U.S. Pat. No. 3,847,779, which operate to prevent deposition of metal on the cathode plate. With the operation of a cylinder 20, slide fixtures 22 fitted to a rod of the cylinder 20 and slidably supported by a guide roller 21 within a guide 24' move forward, and with this forward movement of the slide fixtures, another cylinder 23 and a lifting plate 24 both fixed to the fixtures 22 also move forward. When the slide 22 reaches its forwardmost position within the guide 24' by movement from the position shown in FIG. 6-*b*2, and the cylinder 23 then operates, the lifting plate 24 rotates upwardly about a pin 25, (FIG. 6-*b*3) whereby a roller 26 provided to the front end of the plate 24 abuts against a rib of the movable supporter 81 and the movable supporter is lifted from the cathode plate 80. The movable supporter is then resiliently engaged by a resilient plate 27, so as to prevent its downward movement. The movable supporters thus lifted will not interfere with the polishing of the cathode plate.

Laterally Movable Cathode Transferring Hanger Means D

Figures 2, 8:
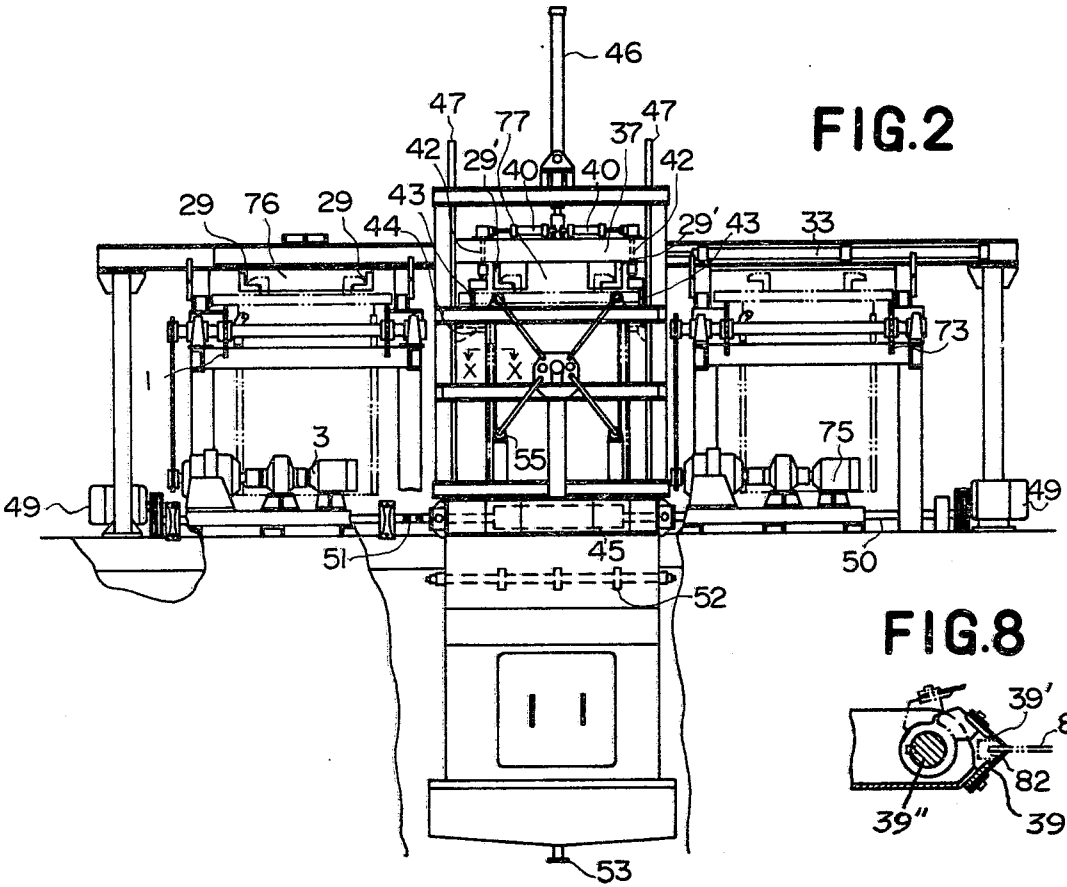
FIG. 2 is a front view of the same.
FIG. 8 is a section taken along X—X in FIG. 2.
Figure 3:
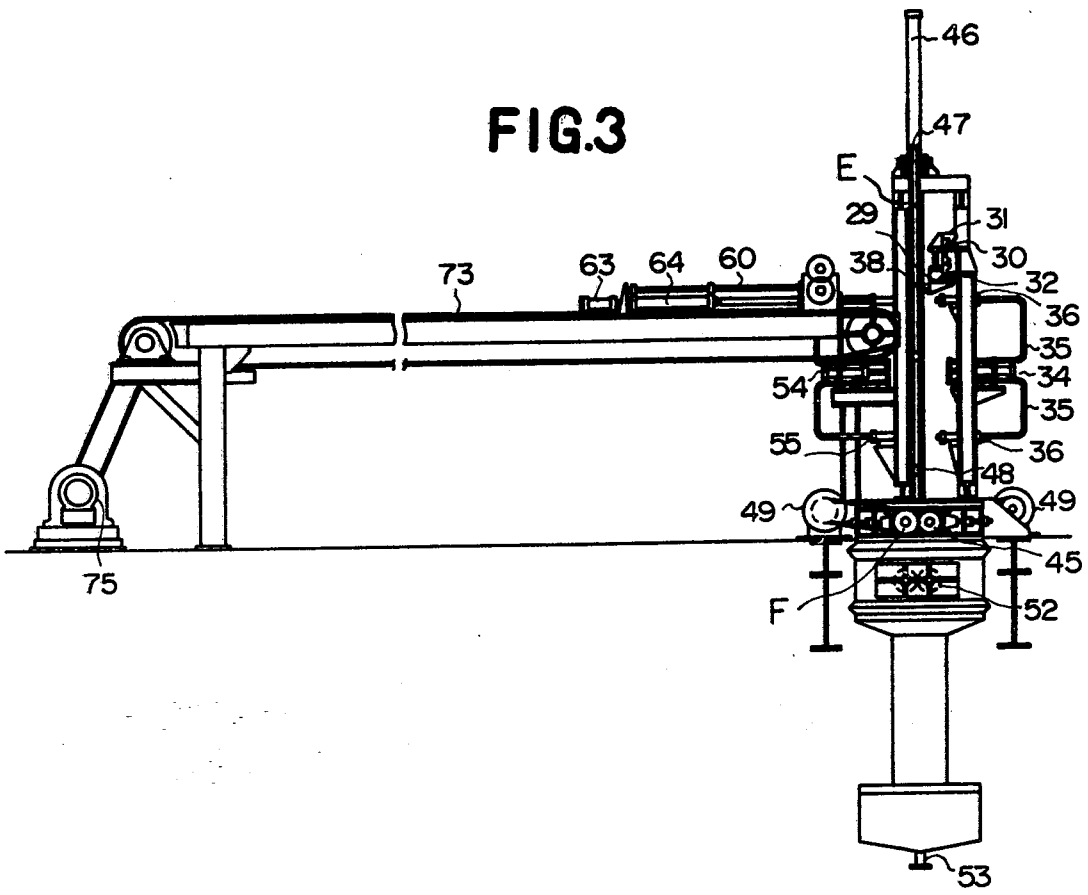
FIG. 3 is a side view of a polishing means and elevator frame.
Figure 3B:
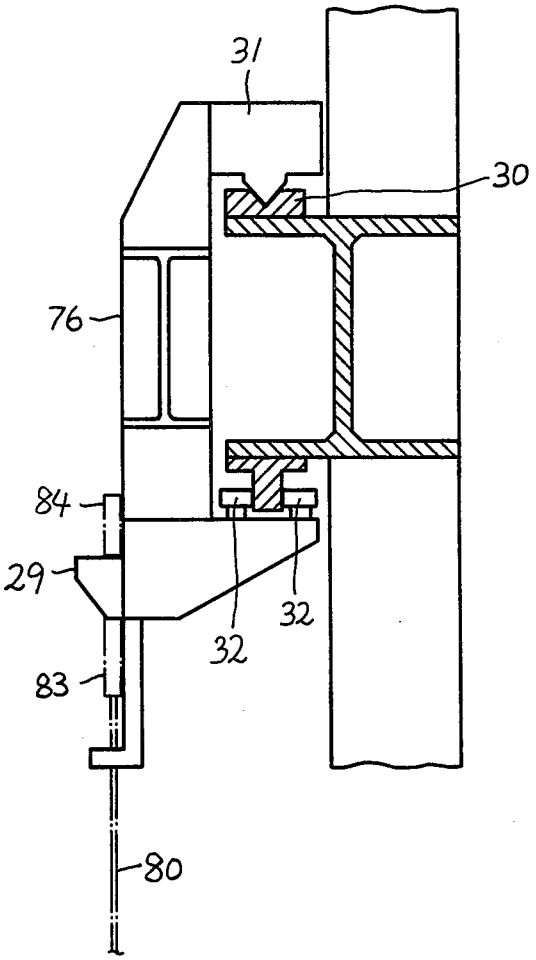

When the cathode plate 80 is forwarded to the position c of FIG. 1 by engagement of the beam 83 between the pawl 6 and the front pawl 11 of the aforementioned supplying means B, a hook 84 of the cathode plate 80 is hung upon a supporting piece 29 of a hanger 76, as best shown in FIG. 2. As best seen in FIG. 3, and in FIG. 3*b*, the laterally movable hanger means D including the hanger 76 consist of a slide piece 31 which is provided with the supporting piece 29 the top end of which is slidably mounted on V-grooved rails 30. The slide piece 31 has, opposite to its top end, rollers 32 which engage with lower surfaces of rails 30 to prevent the cathode plates from swinging transversely to the rails. By means of the operation of a cylinder 33 (FIG. 2), the supporting piece 29 of the forward hanger 76 which is operatively connected with cylinder 33 transfers the cathode plate at the c position to the position d (FIG. 1), and consequently the supporting piece 29' of the rearward hanger 77 works to move the plate at the position d to the position e as illustrated in FIG. 2.

A pair of the hangers D of the same structure are provided, with one of them normally located at the left side in FIG. 2 operating to transfer the cathode plate from the position c to the position d, and with the other operating to transfer the plate from the position d to the position e.

Elevator Frame Means E

As specifically illustrated in FIGS. 1–3 and 13–16, the cathode plate 80 at the position d of FIG. 1 is hung by the hanger 76. When four pushers 36 are moved by a cylinder 34 through wires 35, the cathode plate 80 is pushed by the pushers toward an elevator frame 37 (FIGS. 2 and 3) whereby the hooks 84 of said cathode plate are released from the hanger 76 and then hung by a hanger 38 of the frame 37. When the cathode plate 80 is released from the forward hanger 76, the hanger 76 returns to the position c, while the rearward hanger 77 returns from position e to position d. Before the cathode plate 80 is mounted on the elevator frame 37, protector means, including protectors 39, 39' for covering the stationary supporter or holder 82 of cathode plate 80 (FIGS. 2, 8 and 16), open. The protector means are closed or opened by means of a cylinder 40, a shaft 42 which is rotated by said cylinder, and an arm 41, with a rod 43 and another arm 44 operating to transmit the rotation of the shaft 42 to the protectors. The protectors cover, in their closed position, the stationary supporter 82 as a whole, so as to prevent the abrasion thereof by wire brushes of polishing means F as is explained hereinafter. The protectors also operate to rigidly support the cathode plate so that the plate will not move vertically due to the pressure applied thereto by the wire brushes 45 during the polishing operation.

Subsequently, the elevator frame 37 and the protectors descend by means of an elevator cylinder 46 in order to effect polishing of the cathode plate at the polishing means F. After the cathode plate has been polished, they again ascend, with lateral swinging movement of the frame and the protectors during their elevating operations being prevented by guide rails 47 which are fitted to the elevator frame and which engage guide rollers 48 as illustrated in FIG. 3 and in FIG. 16.

The protector 39 is a stationary protector and the mating protector 39' is movable. They are provided on both lateral sides of a cathode plate 80.

The rotary movement of the shaft 42 which is operated by the cylinder 40 on the top of the elevator frame 37, is transferred to an actuating shaft 39'' to which the movable protector 39' is fitted, via the arm 41, rod 43, and the arm 44. By the rotation of the actuating shaft 39'', the movable protector 39' is closed and opened with respect to the stationary protector 39, whereby the stationary supporter 82 of the cathode plate 80 is covered by the stationary and movable protectors 39, 39', as illustrated in FIG. 8.

Polishing Means F

As best shown in FIG. 3, the polishing means consists of the pair of wire brushes 45 each having a width corresponding to the width of the cathode plate and arranged to face each other with an interval therebetween. The brushes are rotated in parallel with each other by means of an electric motor 49, counter-shafts 50, and universal joints 51. Under the brushes, there are provided a pair of pinch rollers 52 which are made of rubber and control the location of cathode plates to be polished. Further, in order to prevent the abrasion powders from being oxidized, and also in order to wash them, there is provided between the brushes 45 and the plate a nozzle for spraying water onto the plate. The cathode plate 80 descends and ascends by means of the elevator frame 37, and thereby it is polished by brushes 45. Abrasion powders washed up from the plates and brushes are exhausted from a discharge opening 53. After the plate is subjected to one cycle of polishing, viz., one descending and ascending pass, it is hung onto the support piece 29 of the rearward hanger 77 by means of a pusher cylinder 54 and pushers 55, and is then transferred to the position e of FIG. 1. During this operation, the forward hanger 76 is loaded with another cathode plate to be polished.

Cathode Plate Receiving Means G

Figure 9:
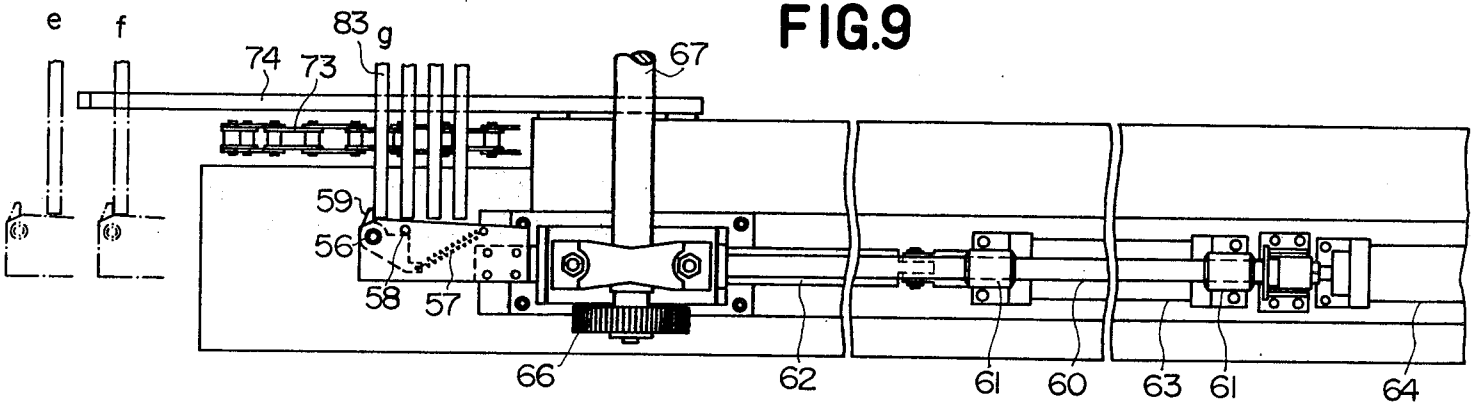
FIG. 9 is a plan view of cathode plate receiving means.
Figure 10:
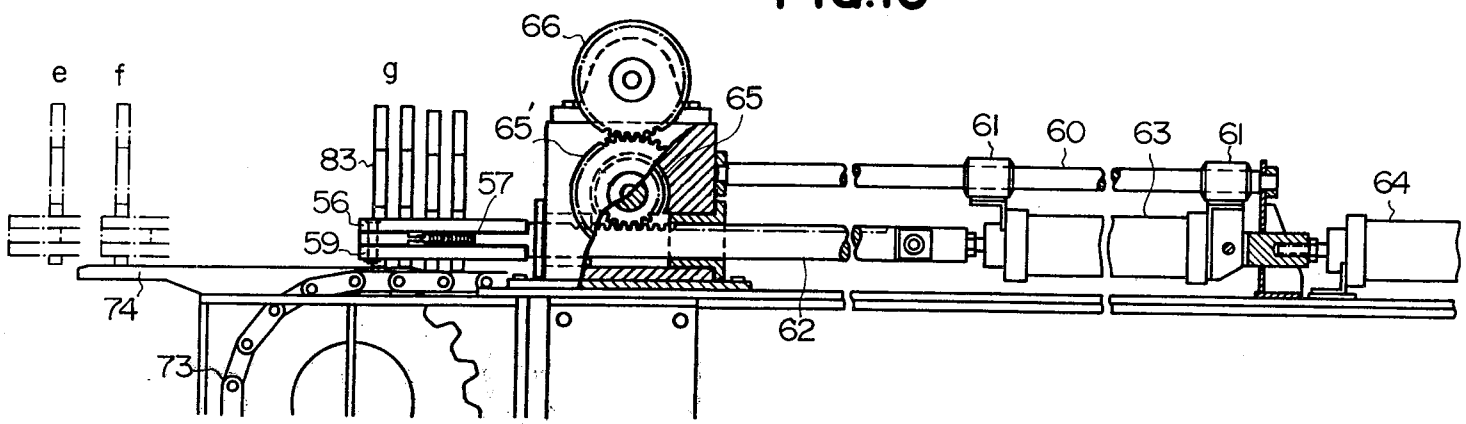
FIG. 10 is a side view of the same.

As specifically illustrated in FIGS. 9 and 10, the cathode plate receiving means includes a pawl 59 which is pivoted to a rack rod 62 by a pin 56 and is biased by a spring 57 to its protruded original position, being halted by a stopper 58. When a cylinder 63 which is slidably supported by a guide rod 60 through guide metals 61 moves forwardly and rearwardly, the pawl 59 by means of the rack rod 62 is operated together with operation of a rear cylinder 64, the pawl 59 being moved to the position e of FIGS. 1, 9, and 10. In the course of its movement the pawl 59 abuts against cathode beam 83, but it is released from abutting engagement by spring 57 and thereafter returns to its original position. When the cylinder 64 withdraws, with the rack rod 62 of rear cylinder 64 extended, the pawl 59 moves backward and the cathode plate is transferred to the position f as illustrated in FIGS. 1, 9, and 10.

Subsequently, when the rack rod 62 is retracted by the cylinder 63, the pawl 59 with the cathode plate 80 is transferred toward the position g, the beam 83 being slidably mounted on rails 74 which run in parallel with chain conveyors 73. The cathode plate 80 is then taken by conveyors 73 at the position g of FIGS. 1, 9 and 10 as the level of the conveyors at the position g is higher than the rails. Gears 65, 65', 66 and a counter-shaft 67 synchronize the left and right pawl devices. The conveyors 73 are driven by a prime motor 75 intermittently for a predetermined distance, so that they are stationary during the period between each cycle.

Backing Means H for Movable Supporters

Figure 12:
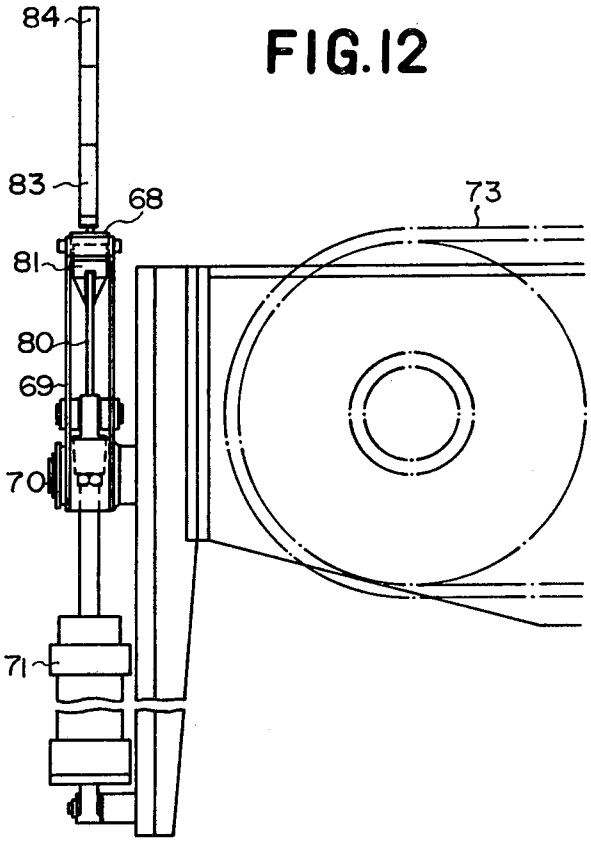
FIG. 12 is a side view of FIG. 11.
Figure 11:
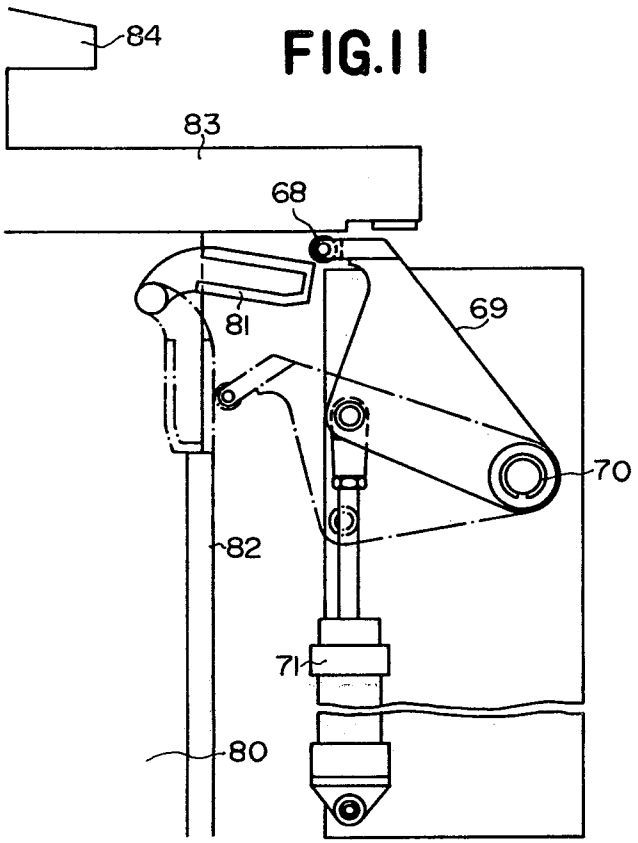
FIG. 11 is a front view of means for pressing down the movable supporters.

In a case where the movable supporters or holders 81 are provided to upper lateral sides of the cathode plates, the backing means is located at the position f, referring to FIGS. 1, 9, and 10. To wit, when the cathode plate 80 returns to position f, an arcuate swinging plate 69 fitted with a roller 68 at its forward end as illustrated in FIGS. 11 and 12 swings downwardly about a pin 70 by means of the operation of a cylinder 71, and pushes the movable supporter 81 downwardly so as to effect inserted fitted engagement thereof with the lateral side of the plate 80. When this operation is completed, the plate 69 returns to its original position, awaiting the next operation.

Thus, as described in the foregoing, each element or segment of the present invention may be operated by pneumatic or hydraulic pressures which may be controlled electrically so as to automatically and sequentially transfer, polish and align cathode plates, whereby manual operations are eliminated, maintenance thereof is made most easy, and safety of operation is assured.

While specific embodiments of the invention have been shown and described in detail to illustrate the application of the inventive principles, it will be understood that the invention may be embodied otherwise without departing from such principles.

What is claimed is:

1. Apparatus for polishing cathode plates for metal electrolytic refinery comprising:

conveyor means upon which cathode plates, which have had electro-depositions stripped off, are suspended in alignment and transferred through said apparatus;

hanger means for supporting said cathode plates;

elevator frame means;

transfer means by means of which the cathode plates suspended and transferred by the conveyor means are supplied individually to said hanger means, said hanger means further transferring the cathode plate for loading the plate onto said elevator frame means;

a stationary supporter mounted on said cathode plate;

said elevator frame means releasably receiving therein the cathode plate and covering said stationary supporter of the said cathode plate mounted thereon;

polishing means provided with a pair of polishing brushes of a length corresponding to the width of the cathode plate and facing against each other with a space therebetween, the cathode plate moving through said space with elevation of said elevator frame means; and second transfer means by which the cathode plate after being polished by the polishing means is unloaded from the elevator frame means.

2. Apparatus according to claim 1 wherein said hanger means operate to transfer said cathode plate onto said elevator frame means while maintaining said movable supporter of said cathode plate at a position remote from the plate, said elevator frame means operating to continuously maintain said movable supporter in said remote position.

3. Apparatus according to claim 2 wherein said second transfer means operate to unload said polished cathode plate from said elevator frame means while moving said movable supporter back to its original position from said remote position.

4. Apparatus according to claim 1 wherein said elevator frame means is movable through an operating cycle comprising a descending and ascending phase of motion, said cathode plate being moved between said polishing brushes and being subjected to said polishing operation with said descending and ascending motion of said elevator frame means.

* * * * *